US011014359B2

(12) United States Patent
Cole-Henry et al.

(10) Patent No.: US 11,014,359 B2
(45) Date of Patent: May 25, 2021

(54) INTERNAL PRINT HEAD FLOW FEATURES

(71) Applicant: FUJIFILM Dimatix, Inc., Lebanon, NH (US)

(72) Inventors: James Leslie Cole-Henry, Enfield, NH (US); Andrew Beech Johns, Grantham, NH (US); Robert L. Wells, Jr., Thetford Center, VT (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 0 days.

(21) Appl. No.: 16/577,174

(22) Filed: Sep. 20, 2019

(65) Prior Publication Data

US 2020/0094551 A1 Mar. 26, 2020

Related U.S. Application Data

(60) Provisional application No. 62/734,384, filed on Sep. 21, 2018.

(51) Int. Cl.
*B41J 2/14* (2006.01)

(52) U.S. Cl.
CPC ..... *B41J 2/1433* (2013.01)

(58) Field of Classification Search
CPC ... B41J 2/1433; B41J 2202/12; B41J 2/14233
USPC ..... 347/47
See application file for complete search history.

(56) References Cited

U.S. PATENT DOCUMENTS

| | | | | |
|---|---|---|---|---|
| 4,847,630 | A * | 7/1989 | Bhaskar | B41J 2/1631 347/63 |
| 5,113,205 | A * | 5/1992 | Sato | B41J 2/19 347/85 |
| 5,648,804 | A | 7/1997 | Keefe et al. | |
| 6,019,465 | A | 2/2000 | Shinada et al. | |
| 6,270,205 | B1 | 8/2001 | Takata | |
| 7,413,295 | B2 | 8/2008 | Takata et al. | |
| 8,172,376 | B2 | 5/2012 | Nathan et al. | |
| 2014/0063132 | A1 * | 3/2014 | Scheffelin | B41J 2/14233 347/71 |

OTHER PUBLICATIONS

PCT International Search Report and Written Opinion issued in International Application No. PCT/US2019/052246 dated Dec. 4, 2019, 9 pages.

* cited by examiner

*Primary Examiner* — Huan H Tran
*Assistant Examiner* — Alexander D Shenderov
(74) *Attorney, Agent, or Firm* — Fish & Richardson P.C.

(57) ABSTRACT

A system and apparatus includes a nozzle formed on a first surface of a substrate, and a fluid passage in the substrate and fluidically connected to the nozzle, the fluid passage being nonlinear along at least a portion of its length and having a cross section that varies along its length, wherein the fluid passage has a width near a second surface of the substrate that is different from a width near a bottom of the fluid passage. A system and apparatus includes a nozzle formed on a surface of a substrate, and a fluid passage defined in the substrate and fluidically connected to the nozzle, the fluid passage having a first portion that substantially lies on a first plane, a second portion that substantially lies on a second plane different from the first plane, and a connecting passage fluidically connecting the first portion to the second portion.

15 Claims, 7 Drawing Sheets

INTERNAL PRINT HEAD FLOW FEATURES

CROSS REFERENCE TO RELATED APPLICATION

This application claims priority under 35 U.S.C. § 120 from U.S. provisional application No. 62/734,384 filed on Sep. 21, 2018. The entire contents of the application is incorporated herein by reference.

TECHNICAL FIELD

This disclosure relates to print head flow channels.

BACKGROUND

Printing high quality, high-resolution images with an inkjet printer generally requires a printer that accurately ejects a desired quantity of ink at a specified location on a printing medium. Typically, a multitude of densely packed ink ejecting devices, each including a nozzle and an associated ink flow path, are formed in a printhead structure. The ink flow path connects an ink storage unit, such as an ink reservoir or cartridge, to the nozzle. The ink flow path includes a pumping chamber. In the pumping chamber, ink can be pressurized to flow toward a descender region that terminates in the nozzle. The ink is expelled out of an opening at the end of the nozzle and lands on a printing medium. The medium can be moved relative to the fluid ejection device. The ejection of a fluid droplet from a particular nozzle can be timed with the movement of the medium to place a fluid droplet at a desired location on the medium.

SUMMARY

In one aspect, an apparatus comprising includes a nozzle formed on a first surface of a substrate, and a fluid passage defined in the substrate and fluidically connected to the nozzle, the fluid passage being nonlinear along at least a portion of a length of the fluid passage and having a cross section that varies along the length of the fluid passage, wherein the fluid passage has a width near a second surface of the substrate that is different from a width near a bottom of the fluid passage.

Implementations include one or more of the features. The width of the fluid passage near the second surface of the substrate is smaller than the width near the bottom of the fluid passage. The width of the fluid passage near the bottom of the fluid passage is about 30% to about 40% greater than the width near the surface of the substrate. The cross section of the fluid passage is symmetric about a longitudinal axis extending from a top to the bottom of the fluid passage. The fluid passage has curved corners joining a bottom of the fluid passage to walls of the fluid passage. The curved corners have a radius of curvature.

In a further aspect, an apparatus includes a nozzle formed on a surface of a substrate, and a fluid passage defined in the substrate and fluidically connected to the nozzle, the fluid passage having a first portion that substantially lies on a first plane, a second portion that substantially lies on a second plane different from the first plane, and a connecting passage fluidically connecting the first portion to the second portion.

Implementations include one or more of the features. The fluid passage has rounded corners joining the first portion and the second portion. The connecting passage has an angle of about 30 degrees to about 75 degrees. The first portion is at a first distance from the surface and the second portion is at a second distance from the surface. The fluid passage is fluidically connected to a reservoir remote from the substrate. The fluid passage fluidically connects fluid from the remote reservoir to the nozzle. A plurality of nozzles is included, and the fluid passage fluidically connects fluid from the remote reservoir to the plurality of nozzles.

In a further aspect, a system includes a reservoir, a pumping chamber comprising an inlet fluidically connected to the reservoir, a nozzle formed on a first surface of a substrate and fluidically connected to the pumping chamber, and a fluid passage defined in the substrate and fluidically connected to the array of nozzles, the fluid passage being nonlinear along at least a portion of a length of the fluid passage and having a cross section that varies along the length of the fluid passage, wherein the fluid passage has a width near a second surface of the substrate that is different from a width near a bottom of the fluid passage.

In a further aspect, a system includes a reservoir, a pumping chamber comprising an inlet fluidically connected to the reservoir, a nozzle formed on a surface of a substrate and fluidically connected to the pumping chamber, and a fluid passage defined in the substrate and fluidically connected to the nozzle, the fluid passage having a first portion that substantially lies on a first plane, a second portion that substantially lies on a second plane different from the first plane, and a fluid connecting passage fluidically connecting the first portion to the second portion.

Advantages of the approaches described here may include, but are not limited to, one or more of the advantages described below. The configuration of the flow pathways can improve the performance of the printhead by encouraging undesirable air bubbles to move freely along the flow pathways with the fluid flow and be purged from the printhead. The configuration of the flow pathways can reduce fluid resistance, thereby increasing the reliability of ink being introduced into the pumping chamber that can be actuated to eject fluid from the printhead as well as enabling air bubbles to move along the flow pathways without becoming trapped.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A fluid ejector, e.g., for an ink jet printer, can include flow pathways that enable an actuator to be actuated rapidly, e.g., at a rate between 10 kHz and 1 MHz, 0 and 250 kHz, 0 and 1 MHz, or higher. Fluid ejectors can enable the actuators associated with the fluid ejectors to be rapidly driven to eject fluid from the fluid ejectors. Fluid drop ejection can be implemented with a substrate, for example, a microelectromechanical system (MEMS) substrate, including a fluid flow body, a membrane, and a nozzle layer. The flow path body has a fluid flow path formed therein, which can include a fluid filled passage, a fluid pumping chamber, a descender, and a nozzle having an outlet. An actuator can be located on a surface of the membrane opposite the flow path body and proximate to the fluid pumping chamber. When the actuator is actuated, the actuator imparts a pressure pulse to the fluid pumping chamber to cause ejection of a droplet of fluid through the outlet of the nozzle. Frequently, the flow path body includes multiple fluid flow paths and nozzles, such as a densely packed array of identical nozzles with their respective associated flow paths. A fluid droplet ejection system can include the substrate and a source of fluid for the substrate. A fluid reservoir can be fluidically connected to the substrate for supplying fluid for ejection. The fluid can be, for example, a chemical compound, a biological substance, or ink.

Figure 1:
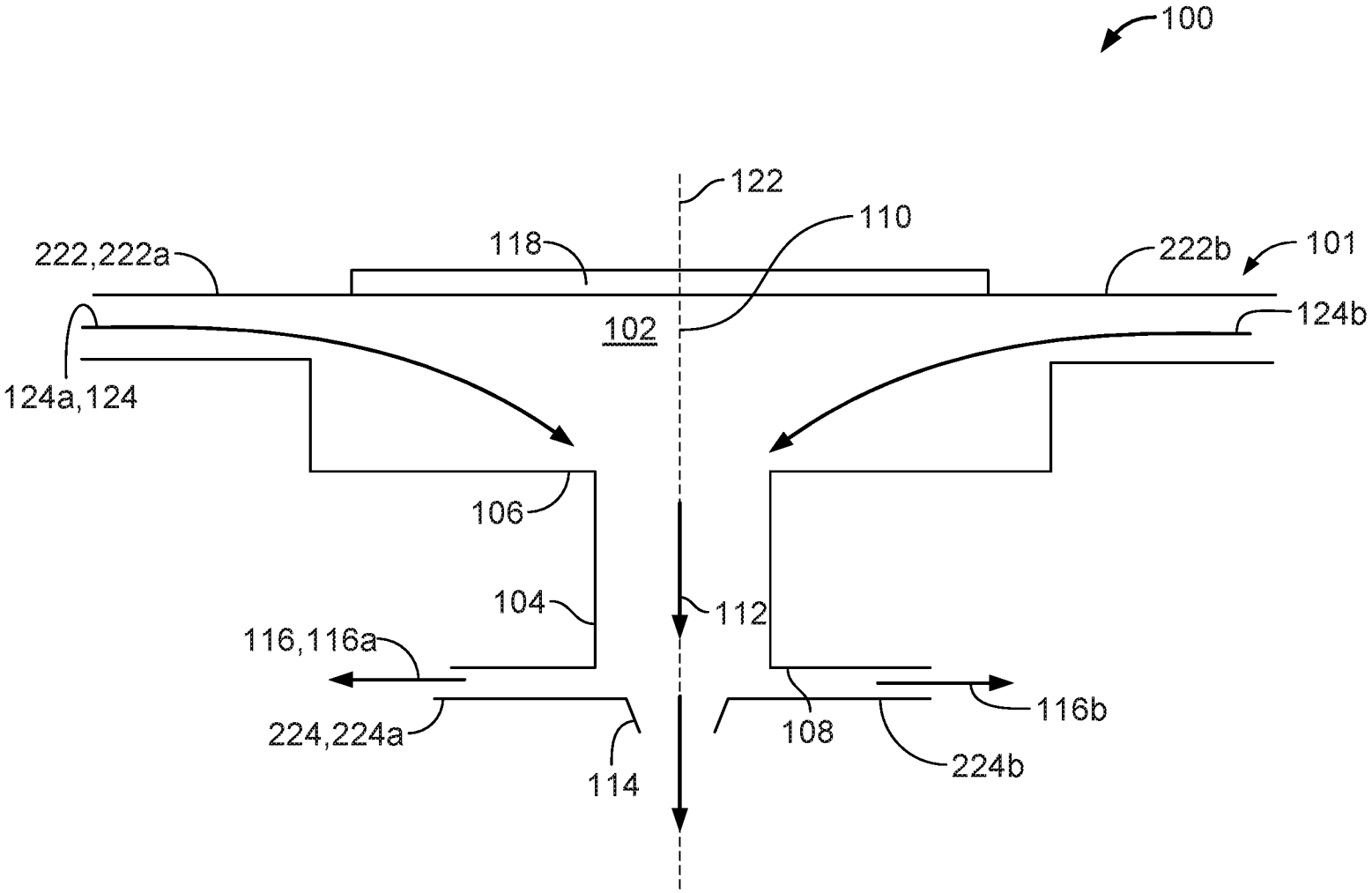
FIG. 1 is a side view of a fluid delivery system.
Figure 2:
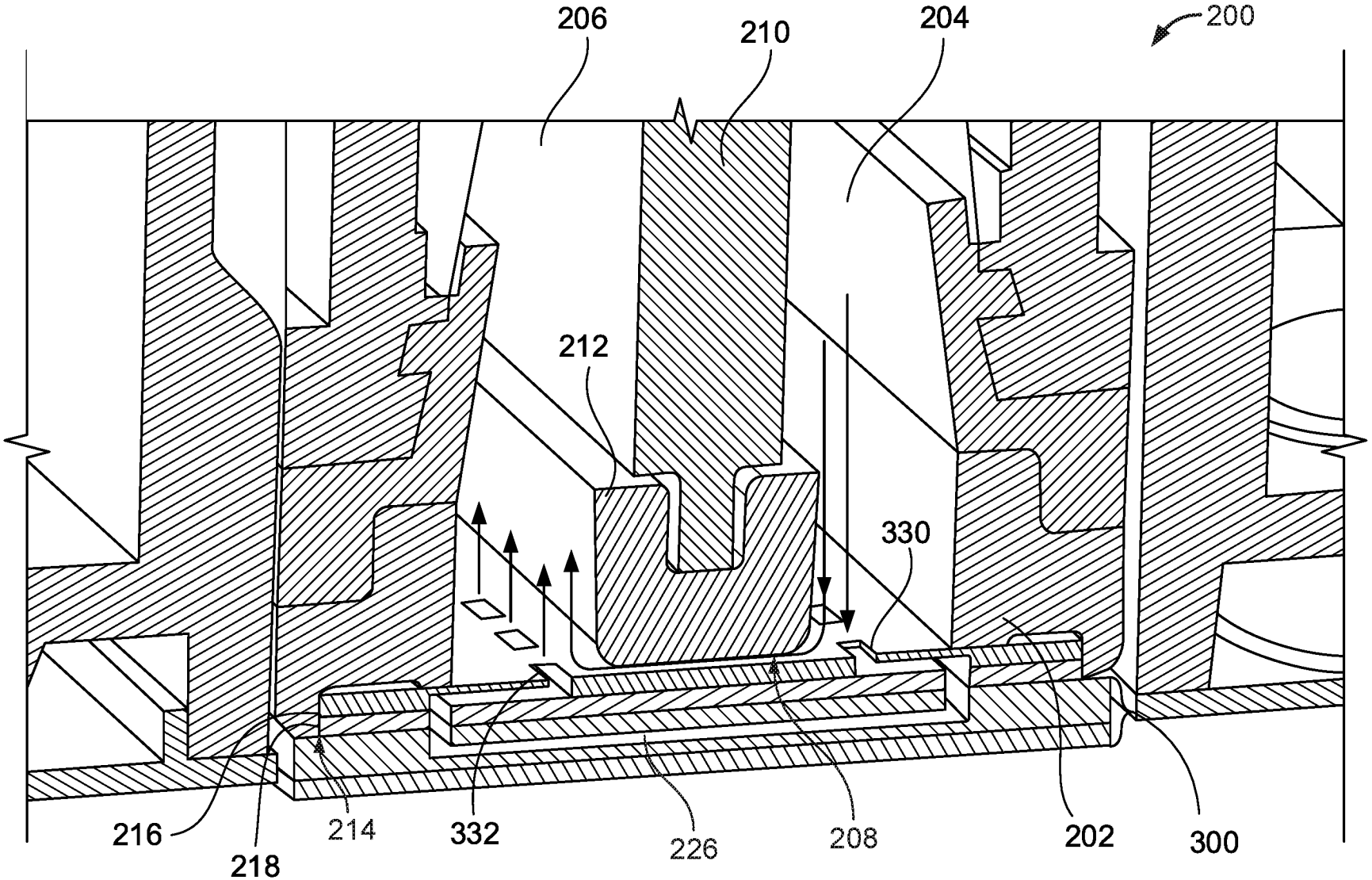
FIG. 2 is a cross-sectional view of a printhead.

FIG. 1 depicts an example of a fluid delivery system 100 including a fluid ejector 101, e.g., for a printhead 200 shown in FIG. 2. The fluid delivery system 100 has a configuration of flow pathways that enables ejection of fluid from a pumping chamber 102 of the fluid ejector 101. The fluid ejector 101 includes flow pathways to transport fluid from a reservoir to a nozzle 114 of the fluid ejector 101. The fluid ejector 101 includes a descender 104 having a first end 106 and a second end 108. The first end 106 defines a first fluid flow pathway 112 between the pumping chamber 102 and the nozzle 114. The nozzle 114 is disposed at the second end 108 of the descender 104. A second fluid flow pathway 116 is defined at the second end 108 of the descender 104. The second fluid flow pathway 116, for example, corresponds to a recirculation pathway to recirculate fluid in an ejection operation, e.g., a printing operation. The recirculated fluid is, for example, returned to the reservoir and reused for a subsequent ejection operation, e.g., a subsequent printing operation. The fluid ejector 101 includes an actuator 118 operable to pump fluid through the pumping chamber 102 toward the nozzle 114.

The first fluid flow pathway 112, for example, corresponds to a fluid flow pathway for fluid that is pumped out of the pumping chamber 102. If the pumping chamber receives fluid from multiple fluid flow pathways, the first fluid flow pathway 112 receives the fluid from the multiple fluid flow pathways such that a single flow of fluid is directed through the descender 104.

Referring to FIG. 2, the printhead 200 ejects droplets of fluid, such as ink, biological liquids, polymers, liquids for forming electronic components, or other types of fluid, onto a surface. The printhead 200 includes one or more fluid ejectors 101, each fluid ejector having a corresponding actuator 118, as described with respect to FIG. 1. The printhead 200 includes a substrate 300 coupled to a deformable membrane 303 of the fluid ejector 101 and to an interposer assembly 214. The substrate 300 is, in some cases, a monolithic semiconductor body, such as a silicon substrate. The substrate has passages formed therethrough that define flow pathways for fluid through the substrate 300. In some implementations, the substrate 300 and the membrane 303 together define the pumping chamber 102. The substrate 300, for example, defines the fluid conduits of the fluid ejector 101, e.g., the pumping chamber 102, the descender 104, the nozzle 114, as well as additional fluid passages 346 described below.

The printhead 200 includes a casing 202 having an interior volume divided into a fluid supply chamber 204 and a fluid return chamber 206. In some cases, the interior volume is divided by a dividing structure 208. The dividing structure 208 includes, for example, an upper divider 210 and a lower divider 212. The bottom of the fluid supply chamber 204 and the fluid return chamber 206 is defined by the top surface of the interposer assembly 214.

The fluid supply chamber 204 includes a reservoir to contain a supply of fluid to be ejected from the printhead 200, e.g., to be ejected through the ejector 101. The reservoir of the fluid supply chamber 204 supplies fluid to the pumping chamber 102. The fluid return chamber 206 includes a reservoir to contain fluid recirculated through the printhead 200 through the second fluid flow pathway 116 described with respect to FIG. 1. The fluid supply chamber 204 has a reservoir to contain the supply of fluid to be ejected from the printhead 200 in the short term, e.g., during a current printing operation or during a next time period. The fluid supply chamber is also in fluidic connection with another, upstream reservoir that contains fluid (e.g., ink) for later use. For example, the upstream reservoir may be an ink cartridge or ink supply.

The interposer assembly 214 is attachable to the casing 202, such as by bonding or another mechanism of attachment. The interposer assembly 214 includes, for example, an upper interposer 216 and a lower interposer 218. The lower interposer 218 is positioned between the upper interposer 216 and the substrate 300.

A flow pathway 226 is formed to connect, e.g., fluidically connect, the fluid supply chamber 204 to the fluid return chamber 206. The upper interposer 216 includes an inlet 330 to the flow pathway 226 and an outlet 332 from the flow pathway 226. The inlet 330 and the outlet 332, for example, are formed as apertures in the upper interposer 216. The flow pathway 226 is, for example, formed in the upper interposer 216, the lower interposer 218, and the substrate 300. The flow pathway 226 enables flow of fluid from the supply chamber 204, through the substrate 300, into the inlet 330, and to the fluid ejector 101 for ejection of fluid from the printhead 200. The actuator 118 of the ejector 101, when driven, ejects fluid from the pumping chamber 102 through the nozzle 114. The flow pathway 226 also enables flow of fluid from the fluid ejector 101, into the outlet 332, and into the return chamber 206.

As described with respect to FIG. 1, the fluid ejector 101 includes the nozzle 114. Fluid is selectively ejected from the nozzle 114 of the fluid ejector 101. The fluid is, for example, ink that is ejected onto a surface to print an image on the surface. The nozzle 114 is formed in a nozzle layer of the substrate 300, e.g., on a bottom surface or a top surface of the substrate 300.

In one example, to be ejected from the printhead 200, a portion of fluid flows through an inlet 222 of the fluid ejector 101, through the pumping chamber 102, through the first end 106 of the descender 104, through the descender 104, through the fluid ejector 101, and out of the printhead 200 through the nozzle 114. To be recirculated, a portion of fluid flows through the inlet 222, through the pumping chamber 102, through the first end 106 of the descender 104, through the descender 104, and through an outlet 224 of the fluid ejector 101. The inlet 222 is, for example, an inlet to the pumping chamber 102. The outlet 224 is, for example, an outlet from the descender 104.

The inlet 222 is, for example, connected to a reservoir to enable fluid flow from the reservoir, e.g., the supply chamber 204. An inlet feed channel 304 connects the supply chamber 204 to the inlet 222 of the fluid ejector 101. The inlet 222 includes a first end connected to the supply chamber 204 through the inlet fluid channel 304 and a second end connected to the pumping chamber 102.

While FIGS. 1 and 2 show various passages, such as pumping chambers and descenders, these components may not all be in a common plane. In some embodiments, different passages and other features may lie in different planes. In some embodiments, portions of a single feature may lie in different planes, e.g., a fluid passage may be sloped so as to cross multiple planes within the printhead 200. In addition, the relative dimensions of the components may vary, and the dimensions of some components have been exaggerated in for illustrative purposes.

Undercutting of Fluid Channels

The nozzle dimensions and the dimensions and shape of the fluid flow paths can affect printing quality, printing resolution, and energy efficiencies of the printing device.

Figure 3A:
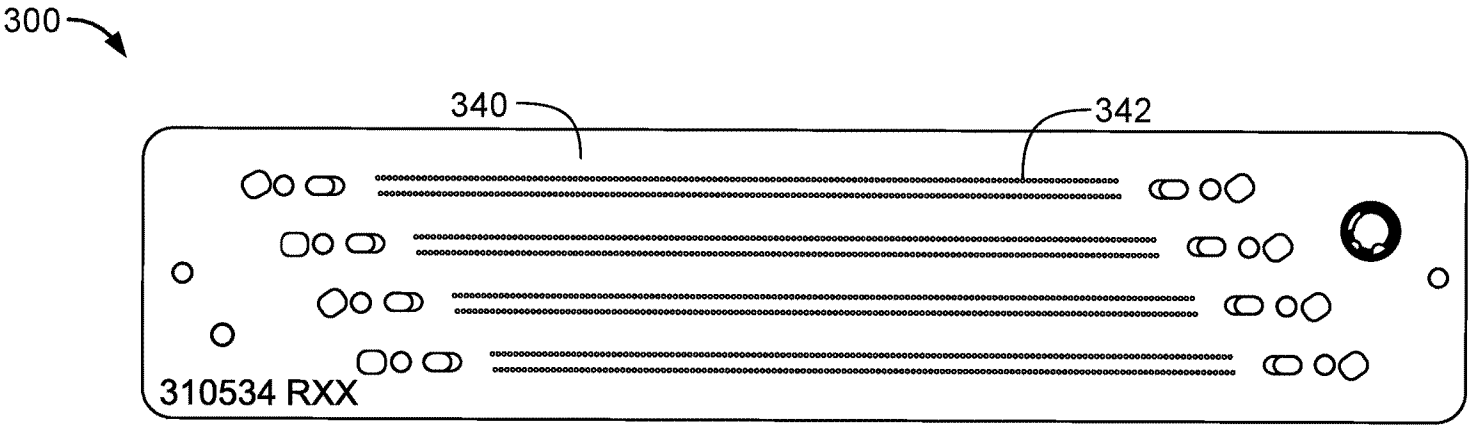
FIGS. 3A and 3B are top and bottom views of a print array.
Figure 3B:
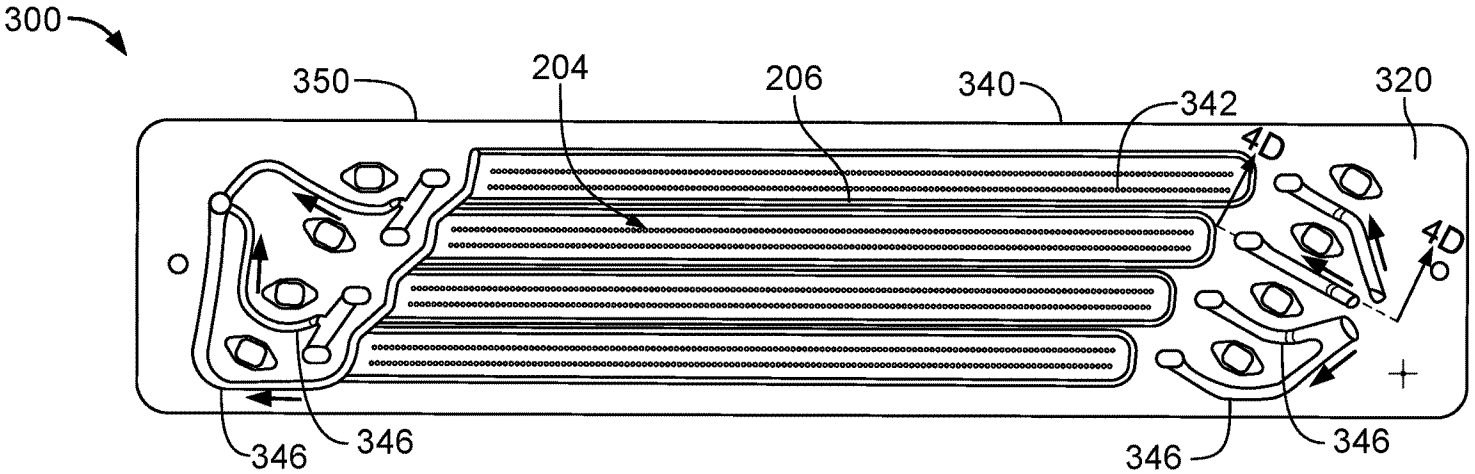

Referring to FIGS. 3A and 3B, the substrate 300 includes many nozzles 342 such as the type described above with respect to FIGS. 1 and 2, arranged in an array 340. The substrate 300 includes multiple flow pathways to transport fluid from reservoirs to eject the fluid, to recirculate the fluid from near the nozzles to be ejected during a subsequent ejection operation, and/or to remove ink from the array 340. These flow pathways include fluid passages 346 (seen in FIG. 3B). The fluid passages 346 direct ink from a distant reservoir (e.g., an ink cartridge) to a closer reservoir (e.g., the supply chamber 204). Multiple supply chambers 204 are defined within the substrate 300 to allow fluid to flow to each of the multiple nozzles 342 in the array 340. Similarly, multiple fluid return chambers 206 can collect unused and non-recirculated ink for flow along additional fluid passages 346 and out from the substrate 300.

As can be seen in FIG. 3B, the bottom surface of the substrate 300 includes several slots and holes that make up the various fluid channels and the nozzles 342. Each of these bottom-surface features reduce the surface area 320 of the bottom surface. However, it is beneficial to increase the surface area 320 that is not given over to fluid passages 346. For example, increasing the surface area 320 can prevent crack prorogation, and provides additional area for adhesive layering (e.g., addition of epoxy or other adhesive to attach the substrate 300 to other components such as the casing 202). It is desirable to create as wide an area as possible between the outermost fluid passages 346 and the edges 350 of the printhead, while not increasing the overall size of the printhead. It is also desirable to increase the distance between fluid passages 346 and the edges 350 of the printhead, or to other features.

Figure 4A:
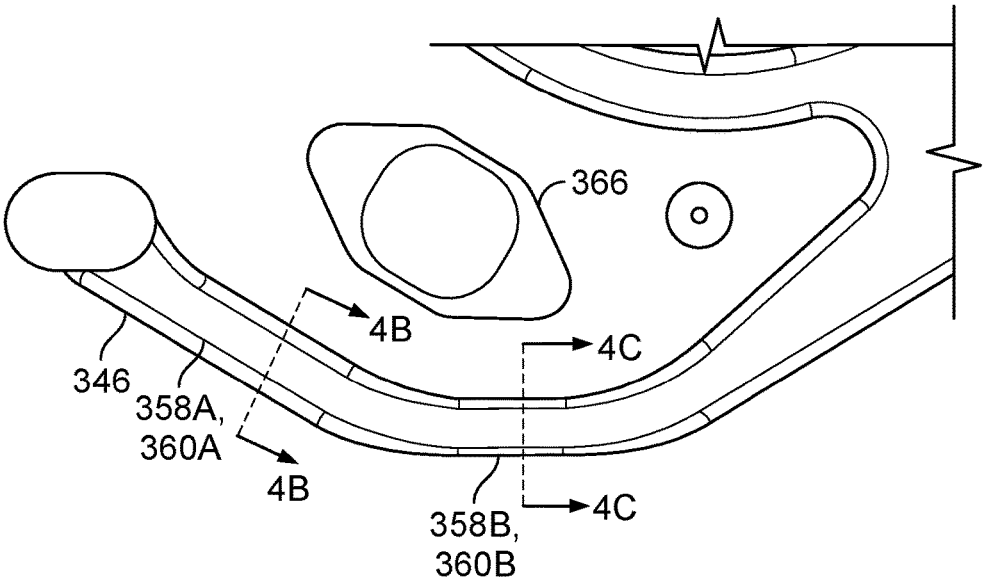
FIG. 4A is a view of a portion of FIG. 3B.

FIG. 4A is a close-up of a portion of FIG. 3B, showing a fluid passage 346 in greater detail. The fluid passage 346 has a curved, non-linear profile as viewed from below. The fluid passage 346 is generally a slot or trench with a long, curved passage machined (e.g., milled, etched, or otherwise fabricated) into the surface of the substrate 300. The fluid passage 346 has an opening on the bottom surface of the substrate 300.

Figure 4B:
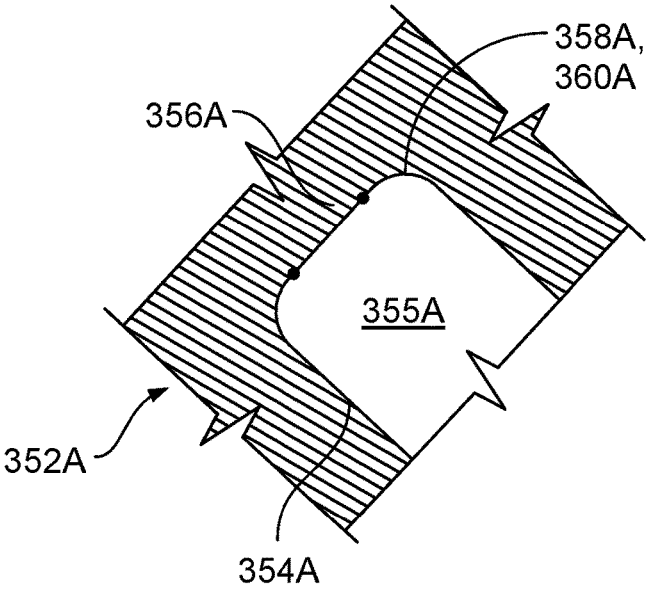
FIGS. 4B and 4C are cross sections through the designated lines shown in FIG. 4A.

One or more of the width and the cross sectional profile of the fluid passage 346 can vary along the length of the fluid passage. In the example of FIG. 4A, the width of the opening of the fluid passage 346 changes along the length of the fluid passage, with the width at the portion marked A being greater than the width at the portion marked B. The cross sectional profile of the fluid passage 346 also changes along the length of the fluid passage. FIG. 4B shows a cross sectional view of the fluid passage 346 at portion A and FIG. 4C shows a cross sectional view of the fluid passage 346 at portion B.

Referring to FIG. 4B, at portion A of the fluid passage 346, the fluid passage 346 has a generally regular cross section 352A, e.g., a rectangular cross section. Sides 354A of the fluid passage 346 are generally straight and substantially parallel. The width of the fluid passage 346 at portion A is substantially constant from the opening 355A of the fluid passage 346 to the bottom 356A of the fluid passage 346. The sides 354A of the fluid passage 346 meet the bottom 356A of the fluid passage 346 at curved corners 358A. The curved corners 358A are rounded with a radius of curvature 360A so that the sides 354A do not meet the bottom 356A at a right angle.

Figure 4C:
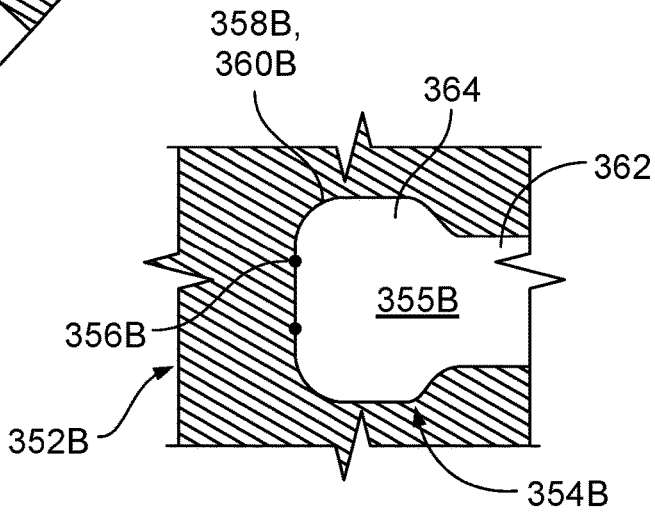

FIG. 4C shows a cross section 352B of the fluid passage 346 at portion B from FIG. 4A. Unlike the cross section 352A, the cross section 352B is not regular and sides 354B of the fluid passage 346 curve more than once before meeting the bottom 356B of the fluid passage 346. The width of the fluid passage 346 at portion B varies across the height of the fluid passage such that the fluid passage is undercut, having a bottom portion 364 at the bottom 356B of the fluid passage 346 that is wider than a top portion 362 at the opening 355B of the fluid passage 346. In some instances, the bottom portion 364 is 30-40% wider than the top portion 362. The sides 354B of the cross section 352B meet the bottom 356B of the fluid passage 346 at curved corners 358B that are rounded with a radius of curvature 360B.

The undercut shape of the fluid passage 346 as shown in FIG. 4C advantageously provides a fluid passage with a large cross sectional area and narrow surface opening 355B. With this undercut configuration, the size of the opening 355B of the fluid passage 346 on the bottom surface of the substrate 300 can be smaller than the opening 355A would be in a non-undercut configuration of the same cross sectional area, enabling the surface area 320 of the bottom surface of the substrate 300 to be larger. For instance, with an undercut fluid passage 346, a wide space can exist between the opening 355B of the fluid passage 346 and the substrate edge 350 or some other feature such as feature 366 in FIG. 4A.

The fluid passage 346 at portion B, with the undercut cross section 352B, has a cross sectional area (e.g., the area of both the top portion 362 and the bottom portion 364) that is greater than the cross sectional area of a fluid passage with a rectangular cross sectional area having the width of the top portion 362. The fluid resistance of a fluid flowing in a channel (such as ink in the fluid passage 346) is directly proportional to the channel's width. Fluid flowing in a narrow channel (e.g., a rectangular cross section channel having the width of the top portion 362) experiences a higher fluid resistance than that of the same fluid flowing in a wider (but shallower) channel of the same cross sectional area. The undercut profile of the cross section 352B reduces how much fluid flows through a narrowed area of the fluid passage 346, e.g., through the top portion 362, reducing the overall fluid resistance as compared to a fluid passage with rectangular cross section of the width of the top portion 362.

The sum of the area of the top portion 362 and the area of the bottom portion 364 of the cross section 352B can be equal to the area of the cross section 352A, or greater than or less than the area of the cross section 352A. The width of the bottom portion 364 at portion B can be wider than the width of the cross section 352A. The radius of curvature 360A and radius of curvature 360B can be the same, or can differ. For example, the radius of curvature 360B can be smaller than the radius of curvature 360A. The radius of curvature 360A and radius of curvature 360B affect the fluid resistance as it is a function of the shape, the cross sectional area, and the aspect ratio of a fluid channel. Generally, the lowest resistance per unit area is achieved with a circular duct, whereas a square duct of the same area has more resistance because the inscribed circle is smaller and the flow in the corners is small. The radius of curvature 360A and radius of curvature 360B help improve the uniformity of flow in the channel.

Figure 4D:
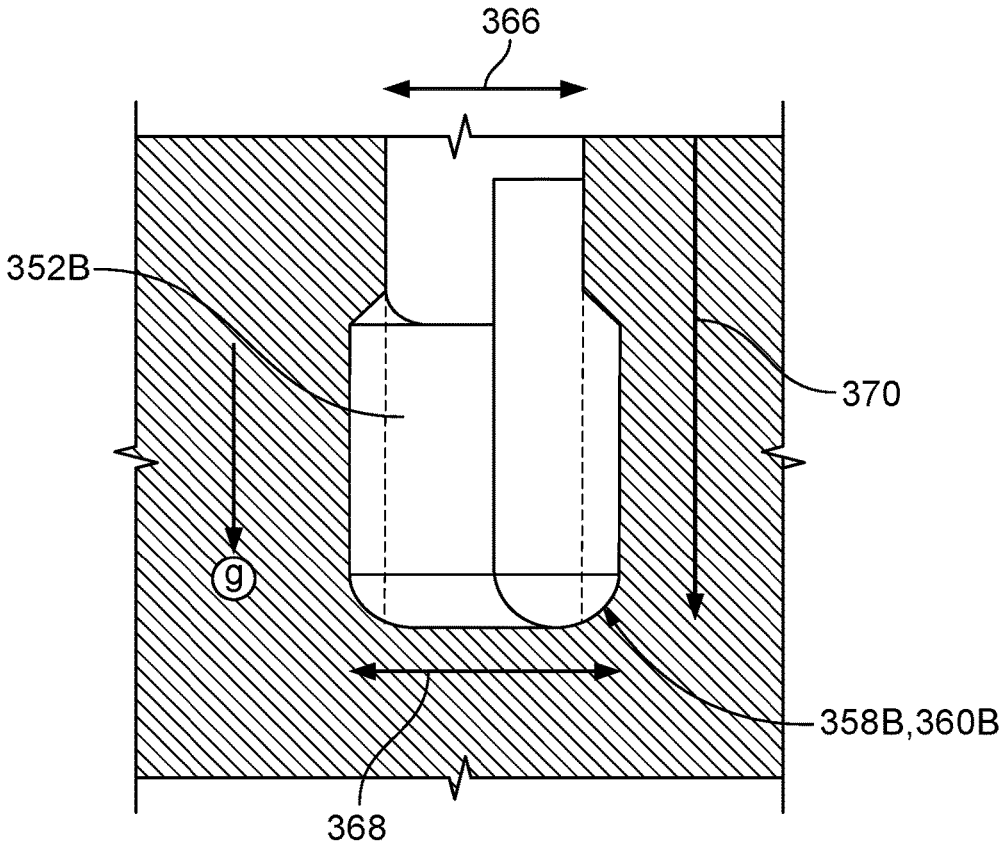
FIG. 4D is a semi-perspective view of the cross section of FIG. 4C.

Referring to FIG. 4D, there are several manufacturing steps to create an undercut cross sectional profile such as that shown in FIG. 4C. First, a cutter is used to drill or mill the fluid passage to the desired top width 366 (e.g., the width of top portion 362) by removing material from the surface of the substrate 300 down to the desired depth 370 of the cross section 352B. This machining creates a straight vertical slot of width 366, as shown by the dotted lines. Next, a wider cutter, such as a T-slot cutter or a relieved cutter, is inserted into the slot of width 366 and height 370 along the centerline of the slot. Once inserted, the wider cutter is used to create the wider bottom of width 368 by shifting the wider cutter to the left and following the edge of the slot for the desired length, and then shifting the wider cutter to the right and following the edge for the desired length on the corresponding side facing the left edge. The curved corners 358B and radius of curvature 360B can be formed using a rounding tool. Alternatively, the curved corners 358 and radius of curvature 360 can result from the shape of the wider cutter. Typically, the resulting cross section 352B is symmetric about its central axis. The result of these steps is an undercut slot with a bottom wider than the throat, resulting in reduced flow resistance while reducing the area removed from the surface of the printhead.

The size and shape of the cross section of the fluid passages 346 can vary along the length of each fluid passage. For example, slots having undercut cross sectional profiles with different dimensions can be present on the same printhead and within the same fluid passage. Modifying the profiles of the fluid passages can compensate for flow imbalance within the nozzle array 340, e.g., by increasing or decreasing the fluid resistance to differing parts of the array 340.

Fluid Path Height Transitions

Figure 5:
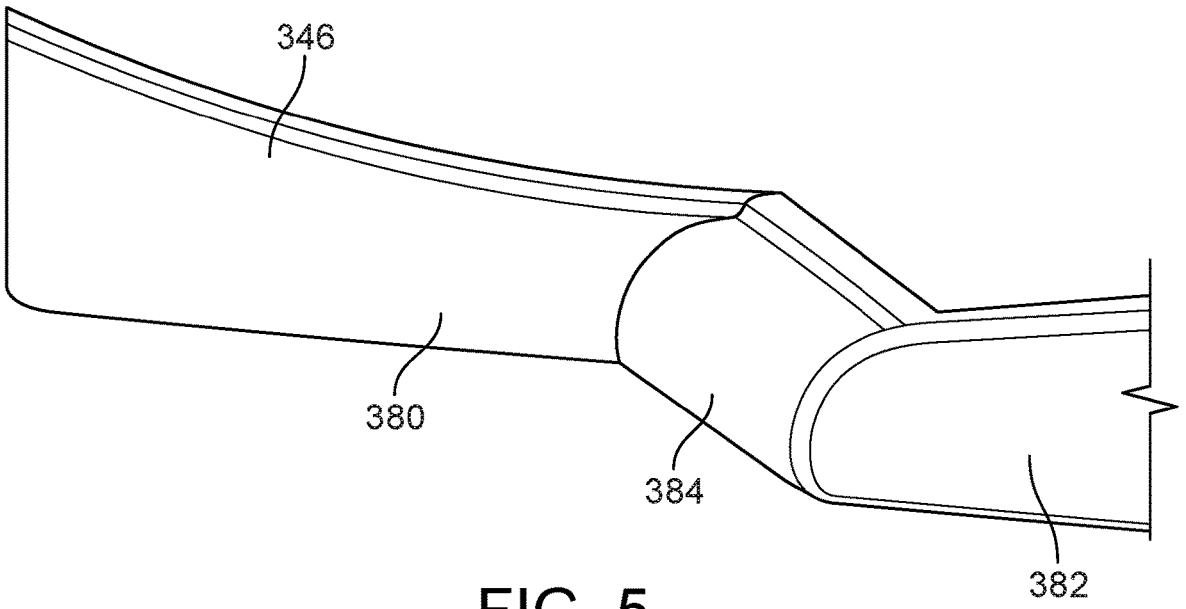
FIG. 5 is a side view of a fluid passage.

As mentioned above, different components interacting with and within the substrate 300 may not all lie in a common plane. Referring to FIG. 5, a fluid passage 346 may itself not lie in a common plane along its entire length. For instance, a fluid passage 346 may have a portion that is positioned deeper within the substrate 300 (referred to as a deep portion of the fluid passage) than another portion of the fluid passage 346 (referred to as a shallow portion of the fluid passage). In the example shown, the fluid passage 346 has a general downwards slant from left to right, as well as a more precipitous change in height at a connecting passage 384.

Any abrupt changes in the depth of the fluid passage 346 act as a bubble trap for undesirable air bubbles in the ink flow, such as air bubbles created from air entering imperfectly formed nozzles. Air bubbles in the ink flow can change the acoustic characteristics of the fluid ejectors 101, or even completely impede the ink flow, negatively affecting the quality and consistency of the printing action carried out by the printhead 200.

A sharp transition from a deep portion to a shallow portion of a fluid passage creates a vertical step that acts as a trap for any air bubble in the ink flow. As shown in FIG. 5, the fluid passage 346 can be angled such that the depth of the fluid passage 346 changes from one depth 380 to another depth 382 at the fluid connecting passage 384. The angle at the fluid connecting passage 384 is not sharp, e.g., the angle is less than 90 degrees. For instance, the angle can be between 30 to 75 degrees. The fluid connecting passage 384 can be a simple height transition from one depth to another (as in FIG. 5 and FIG. 7) or can also include a branching of fluid passages 346 where multiple fluid channels are fluidically connected, e.g., a junction. In some instances, the fluid connecting passage 384 can be straight up and down (e.g., moves ink from one gravitational level to another gravitational level). In other instances, the fluid connecting passage 384 can also move the ink laterally along the substrate 300.

Figure 6:
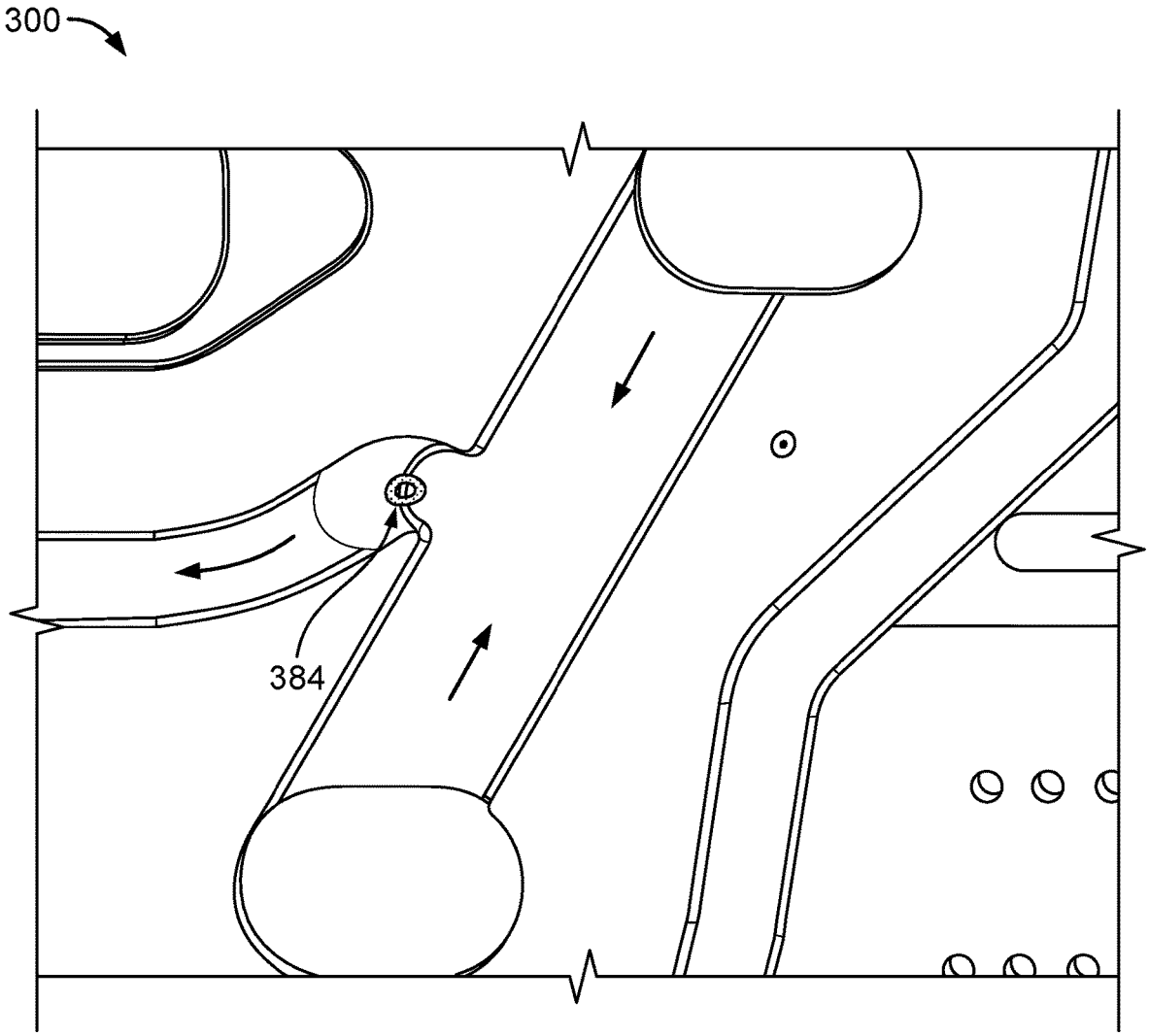
FIGS. 6 and 7 are views of fluid passages viewed from below.
Figure 7:
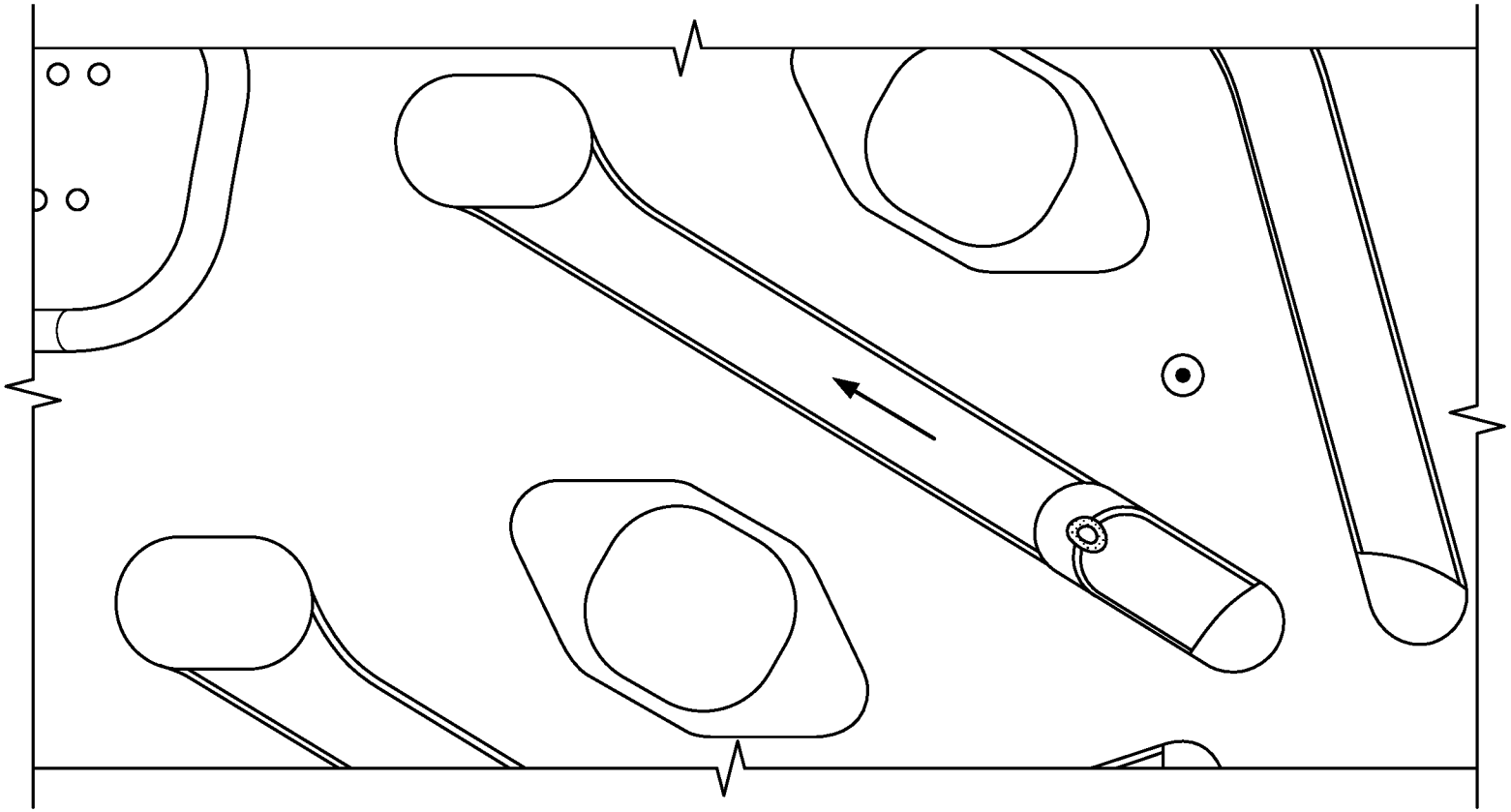

As seen in FIGS. 5-7, the rounded corners 358A or 358B of the fluid passage 346 assist in moving air bubbles along the center of the fluid passage 346 without the air bubble becoming trapped. If the corners 358A, 358B of the fluid passage 346 were sharp (e.g., at right angles), the fluid flow would tend to force any air bubble into the corners. For fluid flow in a channel, the fluid flow in corners is slower than at other portions of the channel, such as at the center. The air bubble forced into a sharp corner would then become more easily trapped due to the slower fluid flow at the corner.

The rounded corners 358A or 358B with their radii of curvature 360A, 360B do not provide low-flow sharp corners. Instead, the rounded corners 358A, 358B encourage an air bubble to go to the center of the channel, keeping the air bubble in the position where most fluid flows around it and thus is exposed to a relatively strong force to move the air bubble along the fluid passage 346 in the direction of the fluid flow.

In some implementations, the fluid passage 346 having a non-uniform cross section can encourage air bubbles to flow with the fluid. The cross sectional area of the fluid passage 346 can vary along the length of the fluid passage, as discussed above. Positioning a connecting passage 384 at a location where the cross sectional area of the fluid passage is narrow (and hence fluid flow is fast) encourages air bubbles to move with the fluid to a greater extent than positioning the connecting passage 384 at a place where the cross sectional area is wide and the fluid flow slow (or at a place with a uniform, unchanging cross section).

The result of the above features is that a printhead 200 is more robust and easier to purge of air bubbles that are injected into the ink flow.

A number of embodiments of the invention have been described. Nevertheless, it will be understood that various modifications may be made without departing from the spirit and scope of the invention. Accordingly, other embodiments are within the scope of the following claims.

What is claimed is:

1. An apparatus comprising:

a nozzle formed on a first surface of a substrate;

a fluid passage defined in the substrate and fluidically connected to the nozzle, wherein during use of the apparatus, fluid in the fluid passage is supplied to the nozzle, the fluid passage being nonlinear along at least a portion of a length of the fluid passage and having a cross section that varies along the length of the fluid passage, wherein the fluid passage has a width near a second surface of the substrate that is different from a width near a bottom of the fluid passage; and a recirculation flow passage defined in the substrate and fluidically connected to the nozzle, wherein during use of the apparatus, fluid that is not ejected from the nozzle is recirculated through the recirculation flow passage.

2. The apparatus of claim 1, wherein the width of the fluid passage near the second surface of the substrate is smaller than the width near the bottom of the fluid passage.

3. The apparatus of claim 2, wherein the width of the fluid passage near the bottom of the fluid passage is about 30% to about 40% greater than the width near the surface of the substrate.

4. The apparatus of claim 1, wherein the cross section of the fluid passage is symmetric about a longitudinal axis extending from a top to the bottom of the fluid passage.

5. The apparatus of claim 1, wherein the fluid passage has curved corners joining a bottom of the fluid passage to walls of the fluid passage.

6. The apparatus of claim 5, wherein the curved corners have a radius of curvature.

7. An apparatus comprising:

a nozzle formed on a surface of a substrate;

a piezoelectric actuator defining at least a portion of a pumping chamber fluidically connected to the nozzle, wherein actuation of the actuator causes ejection of fluid from the nozzle;

a fluid passage defined in the substrate and fluidically connected to the nozzle, wherein during use of the apparatus, fluid in the fluid passage is supplied to the nozzle, the fluid passage having a first portion that substantially lies on a first plane, a second portion that substantially lies on a second plane different from the first plane, and a connecting passage fluidically connecting the first portion to the second portion; and a recirculation flow passage defined in the substrate and fluidically connected to the nozzle, wherein during use of the apparatus, fluid that is not ejected from the nozzle is recirculated through the recirculation flow passage.

8. The apparatus of claim 7, wherein the fluid passage has rounded corners joining the first portion and the second portion.

9. The apparatus of claim 7, wherein the connecting passage has an angle of about 30 degrees to about 75 degrees.

10. The apparatus of claim 7, wherein the first portion is at a first distance from the surface and the second portion is at a second distance from the surface.

11. The apparatus of claim 7, wherein the fluid passage is fluidically connected to a reservoir remote from the substrate.

12. The apparatus of claim 11, wherein the fluid passage fluidically connects fluid from the remote reservoir to the nozzle.

13. The apparatus of claim 11, comprising a plurality of nozzles, and wherein the fluid passage fluidically connects fluid from the remote reservoir to the plurality of nozzles.

14. A system comprising:

a reservoir;

a pumping chamber comprising an inlet fluidically connected to the reservoir;

a nozzle formed on a first surface of a substrate and fluidically connected to the pumping chamber;

a fluid passage defined in the substrate and fluidically connected to the nozzle, wherein during use of the system, fluid flows from the reservoir into the fluid passage and fluid in the fluid passage is supplied to the nozzle, the fluid passage being nonlinear along at least a portion of a length of the fluid passage and having a cross section that varies along the length of the fluid passage, wherein the fluid passage has a width near a second surface of the substrate that is different from a width near a bottom of the fluid passage; and a recirculation flow passage defined in the substrate and fluidically connected to the nozzle, wherein during use of the system, fluid that is not ejected from the nozzle is recirculated through the recirculation flow passage to the reservoir.

15. A system comprising:

a reservoir;

a pumping chamber comprising an inlet fluidically connected to the reservoir;

a nozzle formed on a surface of a substrate and fluidically connected to the pumping chamber;

a piezoelectric actuator defining at least a portion of the pumping chamber, wherein actuation of the actuator causes ejection of fluid from the nozzle;

a fluid passage defined in the substrate and fluidically connected to the nozzle, wherein during use of the system, fluid in the fluid passage is supplied to the nozzle, the fluid passage having a first portion that substantially lies on a first plane, a second portion that substantially lies on a second plane different from the first plane, and a fluid connecting passage fluidically connecting the first portion to the second portion; and a recirculation flow passage defined in the substrate and fluidically connected to the nozzle, wherein during use of the system, fluid that is not ejected from the nozzle is recirculated through the recirculation flow passage to the reservoir.

* * * * *